US008833841B2

(12) United States Patent
Uesugi

(10) Patent No.: US 8,833,841 B2
(45) Date of Patent: Sep. 16, 2014

(54) DEVICE-SUPPORTING MEMBER AND UPPER SLEWING BODY HAVING THE SAME

(75) Inventor: Kazuhiro Uesugi, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 25 days.

(21) Appl. No.: 13/596,253

(22) Filed: Aug. 28, 2012

(65) Prior Publication Data

US 2013/0049404 A1 Feb. 28, 2013

(30) Foreign Application Priority Data

Aug. 31, 2011 (JP) ..... 2011-189449

(51) Int. Cl.
*B62D 21/00* (2006.01)
*E02F 9/10* (2006.01)
*E02F 9/08* (2006.01)

(52) U.S. Cl.
CPC ..... *E02F 9/0833* (2013.01); *E02F 9/0866* (2013.01); *E02F 9/0883* (2013.01)
USPC ..... 296/203.01; 296/193.07; 296/190.01

(58) Field of Classification Search
USPC ..... 296/203.01, 193.07, 190.01, 190.04, 296/183.2, 26.11, 65.05, 26.08, 65.09, 296/183.1, 186.4
See application file for complete search history.

(56) References Cited

U.S. PATENT DOCUMENTS

| | | | | |
|---|---|---|---|---|
| 3,767,254 | A * | 10/1973 | Skanes et al. | 296/203.01 |
| 3,850,473 | A * | 11/1974 | Huber | 296/203.01 |
| 3,984,141 | A * | 10/1976 | Gilette et al. | 296/203.01 |
| 4,220,215 | A * | 9/1980 | Stark | 180/6.7 |
| 7,204,546 | B2 * | 4/2007 | Antonetti | 296/190.04 |
| 7,810,597 | B2 * | 10/2010 | Imashige | 180/69.2 |
| 8,240,415 | B2 * | 8/2012 | Okada et al. | 180/89.17 |

FOREIGN PATENT DOCUMENTS

JP 2007-46240 2/2007

* cited by examiner

*Primary Examiner* — Glenn Dayoan
*Assistant Examiner* — Sunsurraye Westbrook
(74) *Attorney, Agent, or Firm* — Oblon, Spivak, McClelland, Maier & Neustadt, L.L.P.

(57) ABSTRACT

The device-supporting member comprises: an upper horizontal plate portion having an upper surface for placing a cooling unit thereon; a lower horizontal plate portion disposed below the upper horizontal plate portion and having a maintenance hole formed to penetrate therethrough in an up and down direction so as to allow maintenance of the cooling unit; and an upper right vertical plate portion and a lower left vertical plate portion each provided between the upper horizontal plate portion and the lower horizontal plate portion. The upper horizontal plate portion, the upper right vertical plate portion, the lower horizontal plate portion and the lower left vertical plate portion are arranged to define a closed cross-section when viewed in side view. The upper horizontal plate portion has a cutout formed to penetrate therethrough in the up and down direction so as to allow the maintenance of the cooling unit through the maintenance hole.

11 Claims, 9 Drawing Sheets

DEVICE-SUPPORTING MEMBER AND UPPER SLEWING BODY HAVING THE SAME

BACKGROUND OF THE INVENTION

1. Field of the Invention

The present invention relates to a device-supporting member provided in an upper slewing body of a working machine to support a specified device.

2. Description of the Background Art

Generally, in a working machine such as a hydraulic shovel, an upper slewing body is mounted on a crawler type lower propelling body. The upper slewing body comprises an upper frame supported by the lower propelling body slewably about a vertical axis. The upper slewing body further comprises an attachment, a cabin, a machine room, and a counterweight, which are provided on the upper frame. The upper frame has a center section as a core part of the upper frame, and right and left side decks provided to protrude from the center section in laterally opposite directions. The center section has a bottom plate portion extending in a front and rear (longitudinal) direction of a machine body (hereinafter referred to simply as "front and rear (longitudinal) direction"), and a pair of right and left support portions each provided on the bottom plate portion to extend in the longitudinal direction. The attachment is tiltably supported by a front region of the pair of support portions. The counterweight as a heavy load is supported by a rear region of the pair of support portions. The right and left side decks are divided into a plurality of areas along the longitudinal direction. The cabin is disposed on a left front side of the center section. The machine room is provided behind the cabin. The machine room stores therein a cooling unit and others.

As the above type of upper frame, there has been known an upper frame disclosed in JP 2007-046240A. This upper frame has a center section provided in a central region thereof in a right and left (width) direction of the machine body to extend in the longitudinal direction. An engine mount is provided in a rear region of the center section. Further, a cooling-unit mount is provided on a left side of the engine mount. A cooling unit to be attached onto the cooling-unit mount has a structure obtained by integrating an engine-cooling radiator, an intake air-cooling intercooler, and a hydraulic oil-cooling oil cooler. Pipes for the cooling unit, i.e., a radiator hose, an intercooler hose and an oil cooler hose, are connected to a lower portion of the cooling unit. A bottom plate covering a bottom of the cooling-unit mount has a maintenance hole formed at a position adjacent to the pipe connection portion of the cooling unit.

Meanwhile, as means to enhance maintenance accessibility to a device provided on a bottom plate, there is a technique of increasing an area of a maintenance hole formed in the bottom plate. As the technique of increasing the area of the maintenance hole, it is conceivable to add or enlarge the maintenance hole. However, in the cooling-unit mount structure disclosed in JP 2007-046240A, if the maintenance hole is added or enlarged, rigidity of the bottom plate for placing a device thereon will be reduced. This causes a problem of failing to horizontally support the device. Particularly, in a situation where a heavy cooling unit is placed thereon, the problem of insufficient rigidity becomes more prominent.

It is an object of the present invention to provide a device-supporting member capable of maintaining rigidity of a portion for placing a device thereon and capable of adding and enlarging a maintenance opening, and an upper slewing body having the device-supporting member.

SUMMARY OF THE INVENTION

In order to achieve the above object, the present invention provides a device-supporting member to be provided in an upper slewing body of a working machine to support a specified device. The device-supporting member comprises: an upper horizontal plate portion disposed substantially horizontally, wherein the upper horizontal plate has an upper surface for placing the device thereon; a lower horizontal plate portion disposed substantially horizontally below the upper horizontal plate portion, wherein the lower horizontal plate portion has a lower opening formed to penetrate therethrough in an up-and-down direction so as to allow maintenance of the device; and a first vertical plate portion and a second vertical plate portion each provided between the upper horizontal plate portion and the lower horizontal plate portion, wherein the upper horizontal plate portion, the first vertical plate portion, the lower horizontal plate portion and the second vertical plate portion are arranged to define a closed cross-section when viewed in side view, and the upper horizontal plate portion has an upper opening formed to penetrate therethrough in the up-and-down direction so as to allow the maintenance of the device through the lower opening.

The present invention further provides an upper slewing body which comprises the above device-supporting member, and a device placed on the upper surface of the upper horizontal plate of the device-supporting member.

In the present invention, a closed cross-section is formed just below the upper horizontal plate portion for placing the device thereon, so that it becomes possible to add and enlarge a maintenance opening, while maintaining rigidity of the portion for placing the device thereon, thereby providing enhanced maintenance accessibility.

DETAILED DESCRIPTION OF THE PREFERRED EMBODIMENTS OF THE INVENTION (First Embodiment)

With reference to accompanying drawings, a first embodiment of the present invention will now be described. In the first embodiment, a device-supporting member of the present invention will be described based on one example in which the present invention is applied to a cooling-unit mount provided in a hydraulic shovel to support a cooling unit. It is to be understood that the following embodiments are specific examples of the present invention, but they are not intended to limit the present invention thereto.

Figure 1:
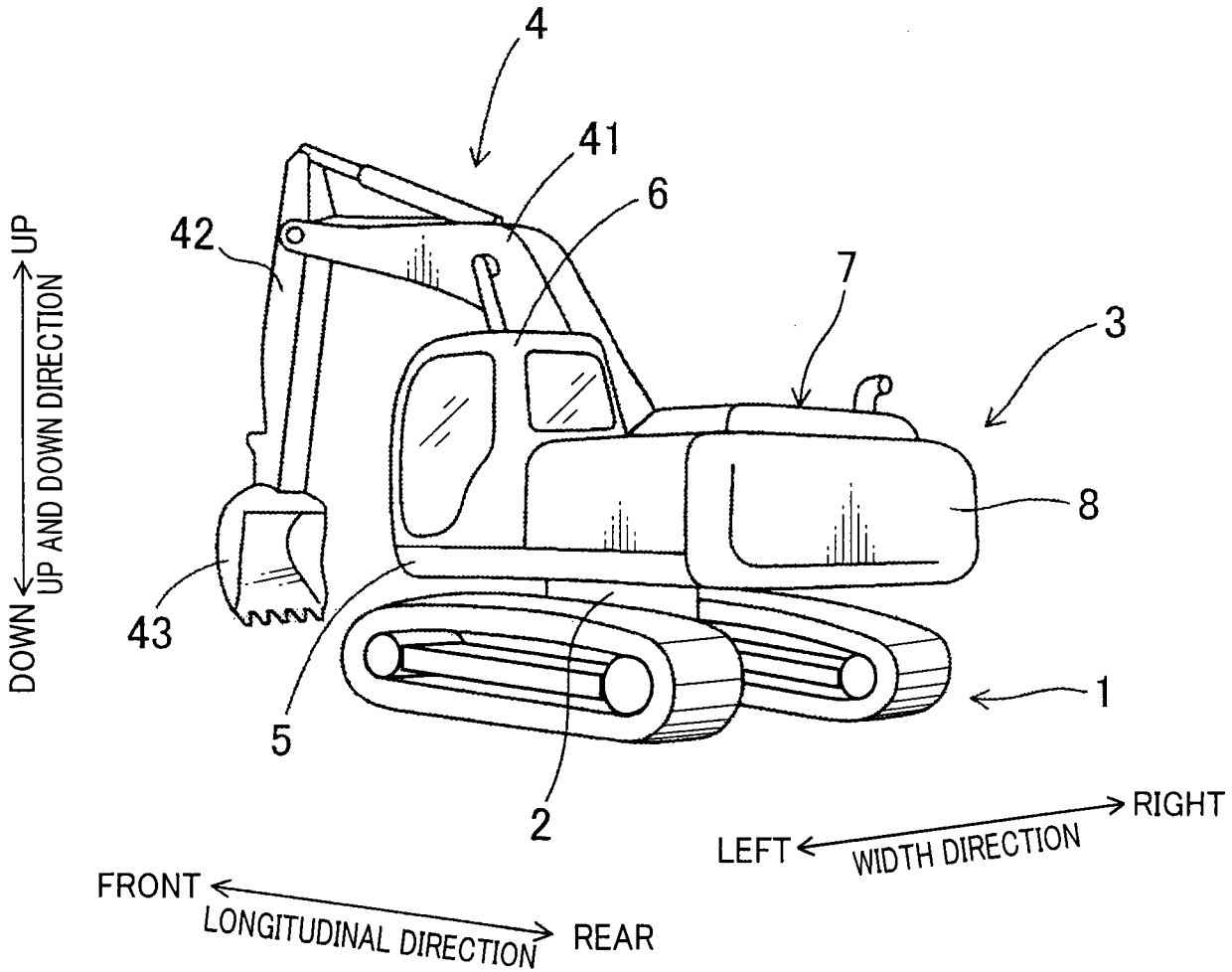
FIG. 1 is a perspective view of a hydraulic shovel according to a first embodiment of the present invention.

FIG. 1 is a perspective view of the hydraulic shovel. The hydraulic shovel comprises a self-propellable crawler type lower propelling body 1, an upper slewing body 3 slewably mounted on the lower propelling body 1 via a slewing mechanism 2, and a attachment 4 tiltably provided with respect to a front of the upper slewing body 3. The lower propelling body 1 and the upper slewing body 3 constitute a machine body of the hydraulic shovel. In the following description, directions (a front-and-rear (longitudinal) direction of the shovel body, a right-and-left(width) direction of the shovel body, and an up-and-down direction) illustrated in FIG. 1 will be used, unless otherwise mentioned.

The upper slewing body 3 comprises an upper frame 5 attached to the slewing mechanism 2 slewably about a vertical axis. The upper slewing body 3 further comprises a cabin 6, a machine room 7, and a counterweight 8, a cooling unit (device) 71 (see FIG. 2), an engine (illustration is omitted), a pump (illustration is omitted), and an aftermentioned cooling-unit mount 12 (see FIG. 2), which are provided on the upper frame 5. The cabin 6 is mounted on a left front region of the upper frame 5. The machine room 7 is mounted on the upper frame 5 at a position behind the cabin 6. The counterweight 8 is mounted on the upper frame 5 at a position behind the machine room 7.

The attachment 4 is used to perform soil excavation work or the like. Specifically, the attachment 4 comprises a boom 41 having a base end provided raisably and lowerably with respect to the upper slewing body 3, an arm 42 having a base end swingably attached to a distal end of the boom 41, and a bucket 43 rotatably attached to a distal end of the arm 42. The boom 41 is supported with respect to the upper slewing body 3 tiltably in a longitudinal direction of the shovel body. The attachment 4 is adapted to be moved according to an instruction from an operator in the cabin 6. For example, the attachment 4 can perform a movement of largely inclining the boom 41 frontwardly through a tilt-down operation to stretch the arm 42, or a movement of raising the boom 41 through a tilt-up operation to fold the arm 42.

The cabin 6 is designed to allow an operator to ride thereon. Specifically, for example, the cabin 6 comprises a driver seat for an operator, a traveling operation lever and a working operation lever (which are not illustrated). The driver seat and the operation levers are provided within the cabin 6.

The machine room 7 is a compartment provided to extend between widthwise opposite ends in a rear of the upper slewing body 3. The cooling unit (device) 71 (see FIG. 2), the engine (illustration is omitted) and the pump (illustration is omitted) are provided in a rear region of an internal space of the machine room 7. The cooling unit 71, the engine and the pump are arranged along a width direction of the shovel body from the left side in this order.

The counterweight 8 is designed to maintain balance against the tilt operation of the attachment 4. Specifically, a weight of the counterweight 8 is set depending on a weight, type, etc., of the attachment 4. The counterweight 8 is provided in a region behind the machine room 7 and between the widthwise opposite ends.

Figure 2:
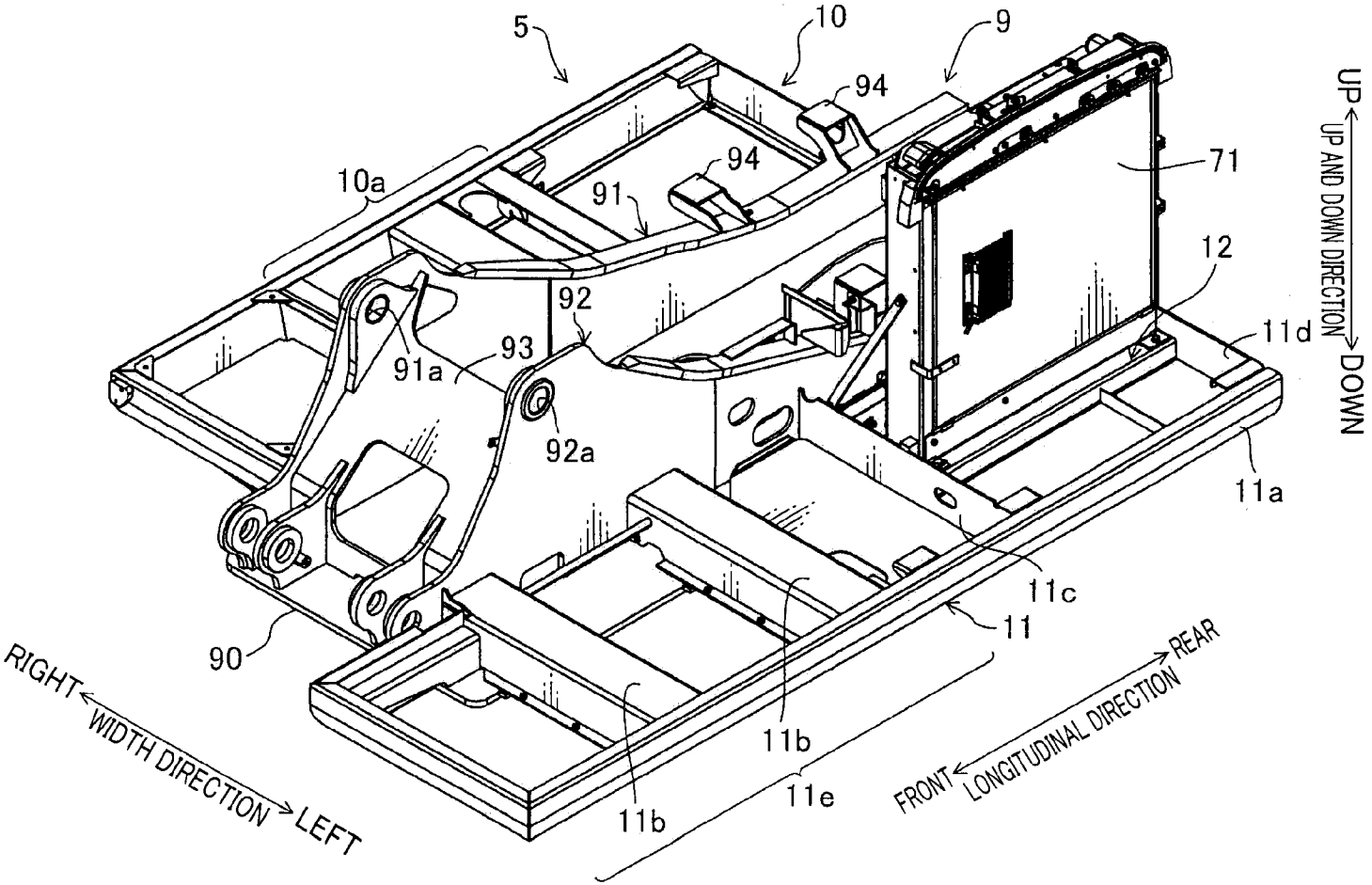
FIG. 2 is a perspective view illustrating a state in which a cooling unit is attached onto an upper frame illustrated in FIG. 1.
Figure 3:
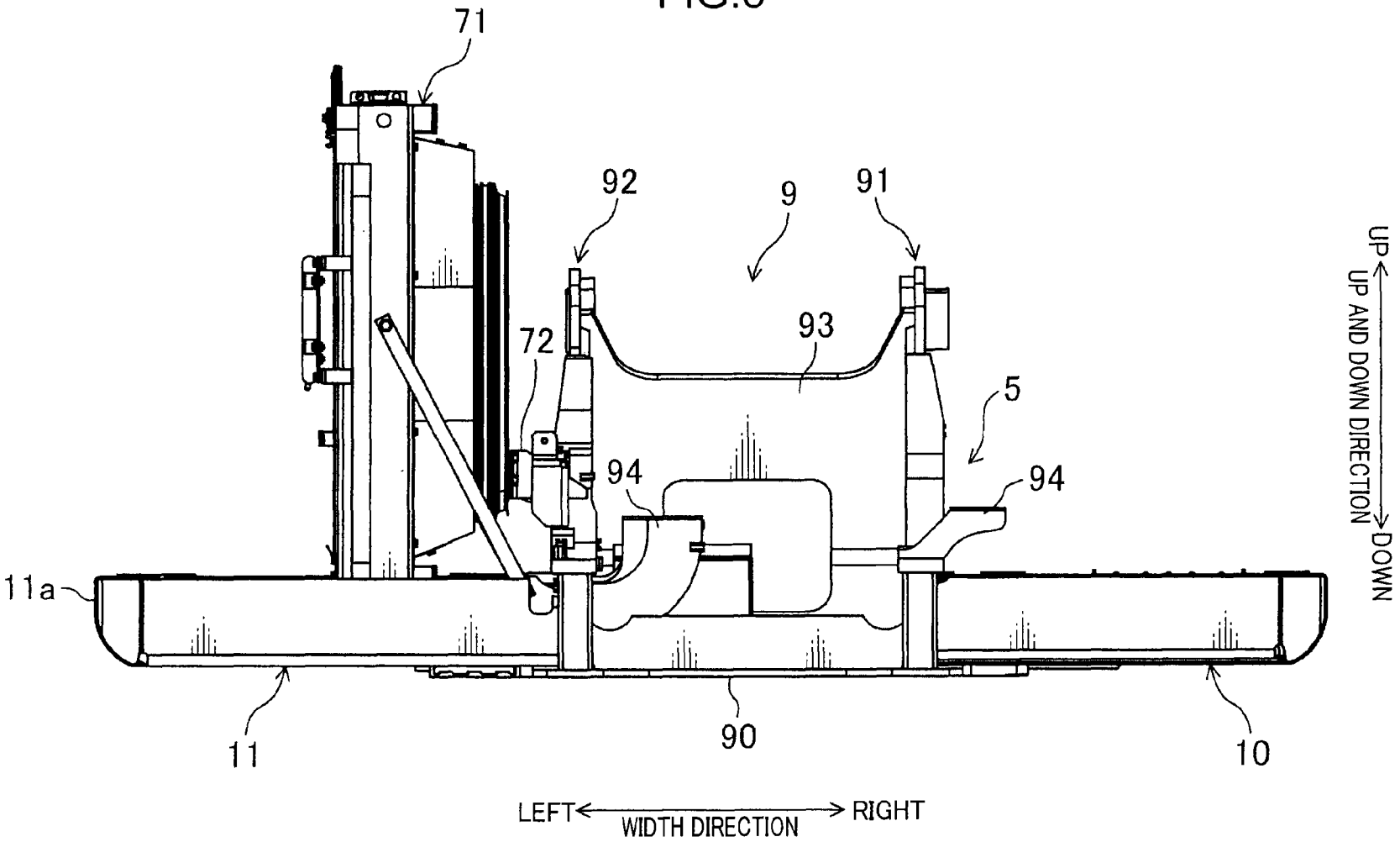
FIG. 3 is a back view of the upper frame illustrated in FIG. 2.
Figure 4:
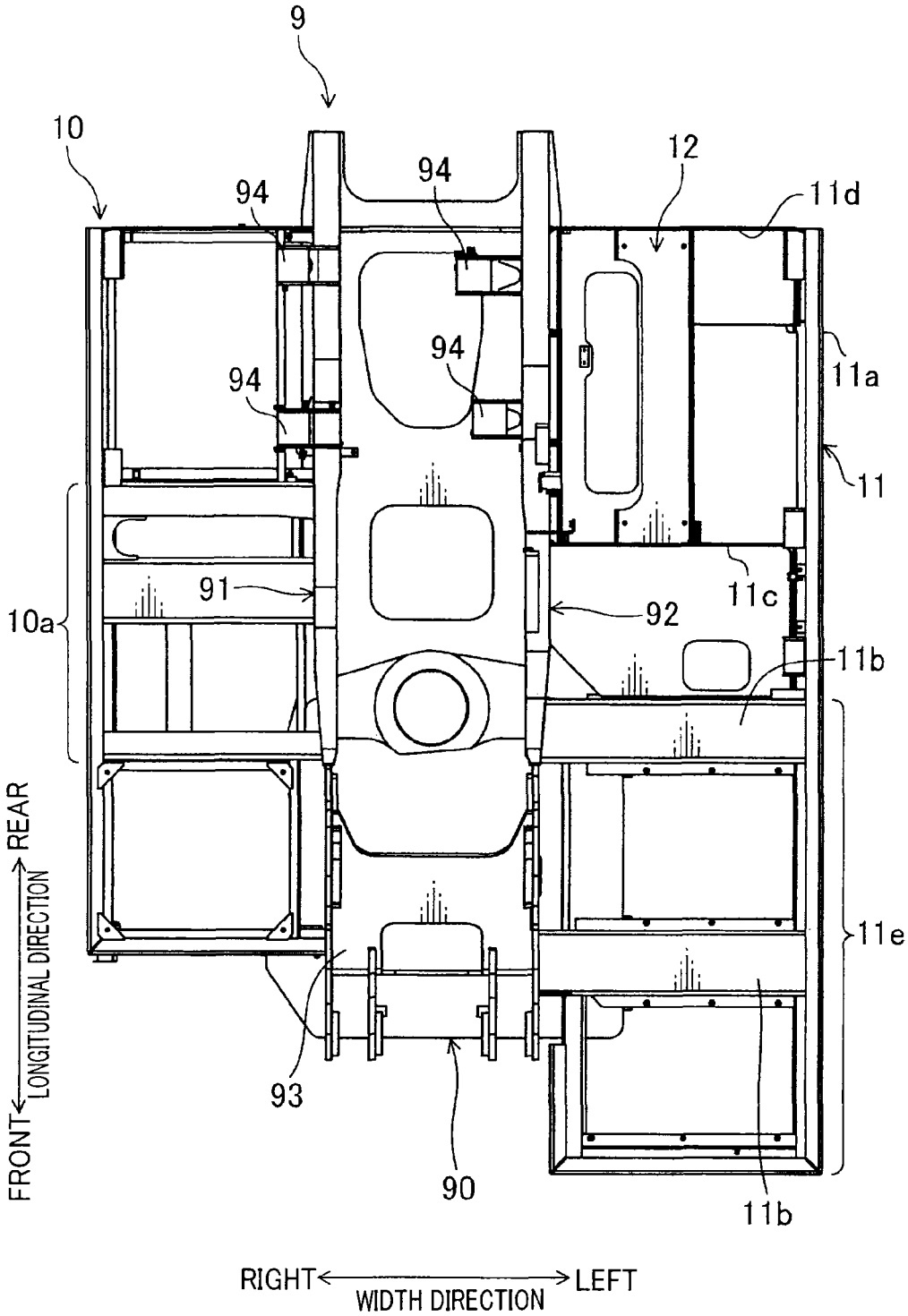
FIG. 4 is a top plan view of the upper frame illustrated in FIG. 1.

With reference to FIGS. 2 to 4, a structure of the upper frame 5 will be described below. FIG. 2 is a perspective view illustrating a state in which the cooling unit is attached onto the upper frame illustrated in FIG. 1. FIG. 3 is a back view of the upper frame illustrated in FIG. 2. FIG. 4 is a top plan view of the upper frame illustrated in FIG. 1.

The upper frame 5 comprises a center section 9 extending in the longitudinal direction in a widthwise central region of the upper frame 5, a right side deck 10 disposed on a right side of the center section 9, and a left side deck 11 disposed on a left side of the center section 9. The attachment 4, the engine and the counterweight 8 are attached to the center section 9 in this order from the front side. Electric components such as a battery, a fuel tank and others are attached to the right side deck 10. The cabin 6 is attached to a front region of the left side deck 11, and the cooling unit 71 is attached to a rear region of the left side deck 11.

The center section 9 is a core part of the upper frame 5. Specifically, the center section 9 comprises a bottom plate portion 90, a pair of support portions 91, 92 standingly provided on the bottom plate portion 90 to extend parallel to each other along the longitudinal direction and face each other in the width direction, a reinforcing member 93 coupling respective front ends of the pair of support portions 91, 92 together, and a mounting seat portion 94 for attaching the engine to a rear region of the pair of support portions 91, 92. The pair of support portions 91, 92 have, respectively, shaft holes 91*a*, 92*a* provided in front ends thereof to pivotally support the base end of the boom 41.

The right side deck 10 is formed in a rectangular shape extending in the longitudinal direction, in top plan view. The right side deck 10 has a longitudinal length substantially equal to that of the bottom plate portion 90 of the center section 9. The right side deck 10 is divided into three areas in the longitudinal direction. A fuel tank (illustration is omitted) and a hydraulic oil tank (illustration is omitted) are placed on a central one 10*a* of the three areas. The fuel tank and the hydraulic oil tank are supported by the right side deck 10.

The left side deck 11 is formed in a rectangular shape extending in the longitudinal direction, in top plan view. The left side deck 11 has a longitudinal length greater than that of the bottom plate portion 90 of the center section 9. The left side deck 11 comprises a left side frame 11*a* extending in the longitudinal direction, two cabin-supporting members 11*b* each provided between the support portion 92 and the left side frame 11*a*, a coupling member 11*c*, and a rear-end coupling member 11*d*. A front portion of the left side frame 11*a* protrudes frontwardly with respect to the right side deck 10. The two cabin-supporting members 11*b* are provided side-by-side in a front region of the left side deck 11. A cabin support space 11*e* (see FIGS. 2 and 4) for supporting the cabin 6 is formed by the cabin-supporting members 11*b* and the front portion of the left side frame 11*a*. The cabin 6 is supported through non-illustrated four mount members provided, respectively, at four corners of the cabin support space 11*e*. The coupling member 11*c* is provided behind a rear one of the cabin-supporting members 11*b* in spaced-apart relation to the rear cabin-supporting member 11*b*. The rear-end coupling member 11*d* is provided behind the coupling member 11*c* in spaced-apart relation to the coupling member 11*c*.

In the first embodiment, a generally rectangular-shaped cooling-unit mount 12 is provided in a rectangular area surrounded by the coupling member 11*c*, the rear-end coupling member 11*d*, the support portion 92 and the left side frame

11*a* (details thereof will be discussed later). Specifically, a peripheral edge of the cooling-unit mount 12 is welded to the coupling member 11*c*, the rear-end coupling member 11*d*, the support portion 92 and the left side frame 11*a*. Consequently, the cooling-unit mount 12 makes up a bottom plate portion of the rectangular area.

The cooling unit 71 is formed by integrating a radiator, an intercooler and an oil cooler together. As illustrated in FIG. 3, the cooling unit 71 has three hose-attaching portions 72 protruding rightwardly, i.e., toward the center section 9. Specifically, the hose-attaching portions 72 includes a hose-attaching portion for allowing a radiator hose to be attached to a lower portion of the radiator, a hose-attaching portion for allowing an intercooler hose to be attached to a lower portion of the intercooler, and a hose-attaching portion for allowing an oil cooler hose to be attached to a lower portion of the oil cooler. The hose-attaching portions 72 are provided around a longitudinal center in a lower end region of a right surface of the cooling unit 71. In FIG. 3, only a rearmost one of the three hose-attaching portions 72 is illustrated, but the remaining two are hidden behind the rearmost hose-attaching portion 72.

Figure 5:
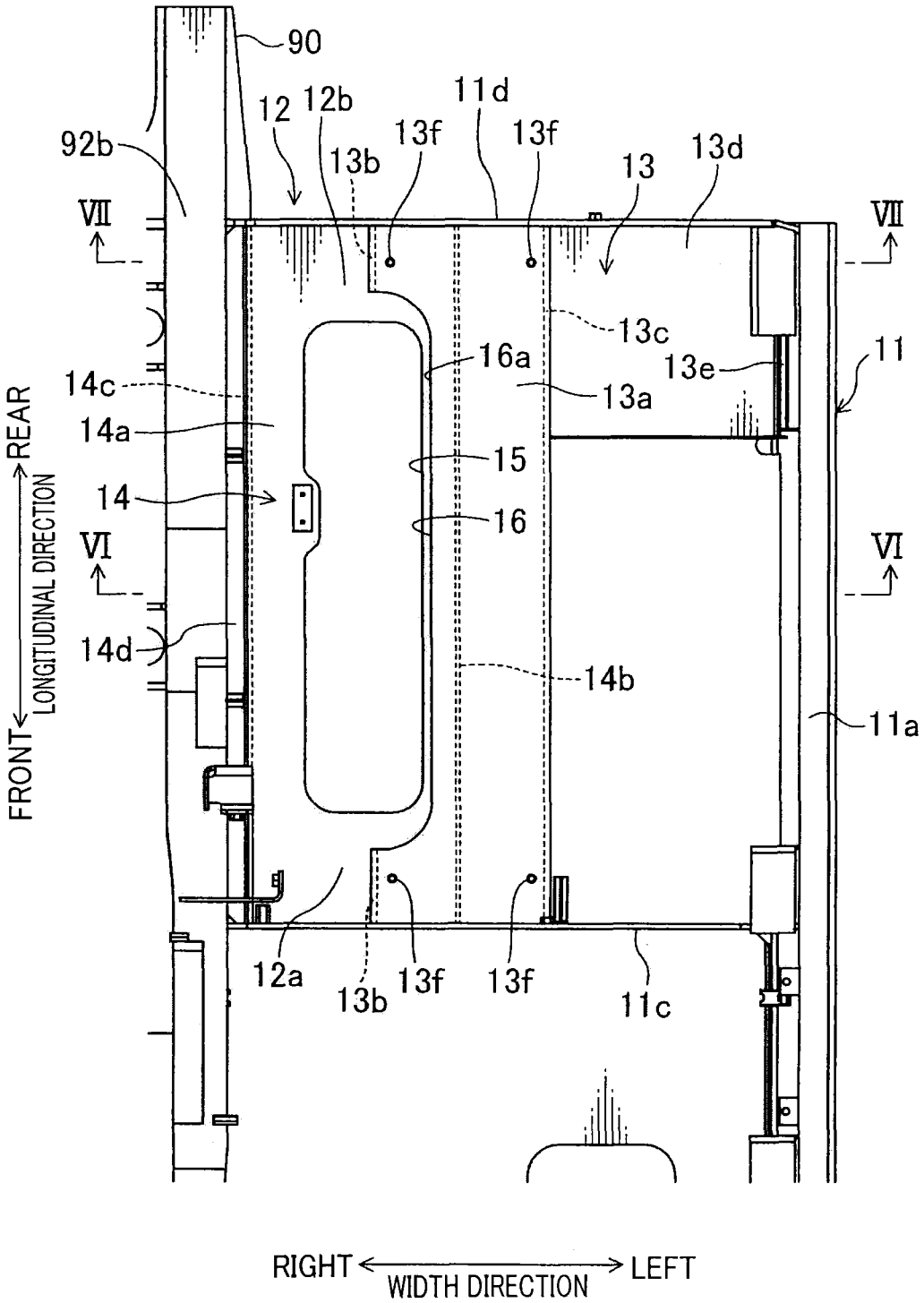
FIG. 5 is a top plan view enlargedly illustrating a cooling-unit mount illustrated in FIG. 4.
Figure 6:
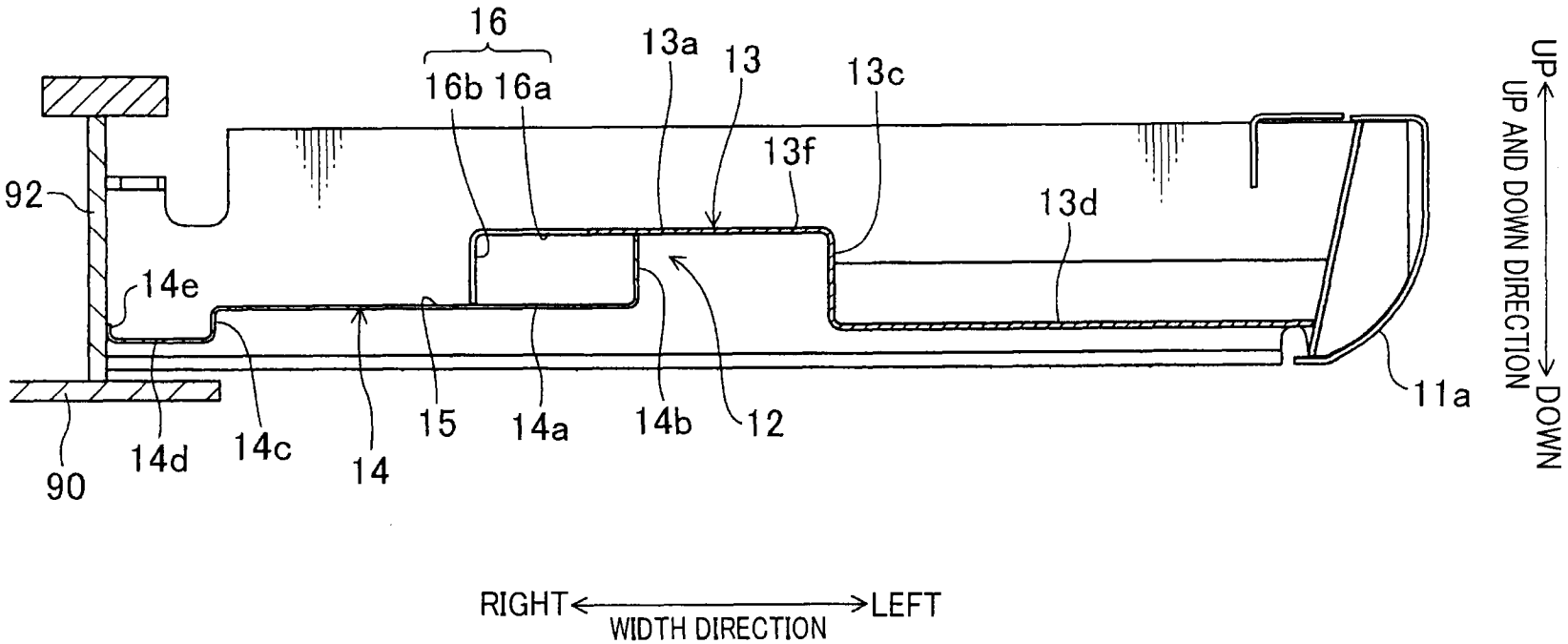
FIG. 6 is a sectional view taken along the line VI-VI in FIG. 5.
Figure 7:
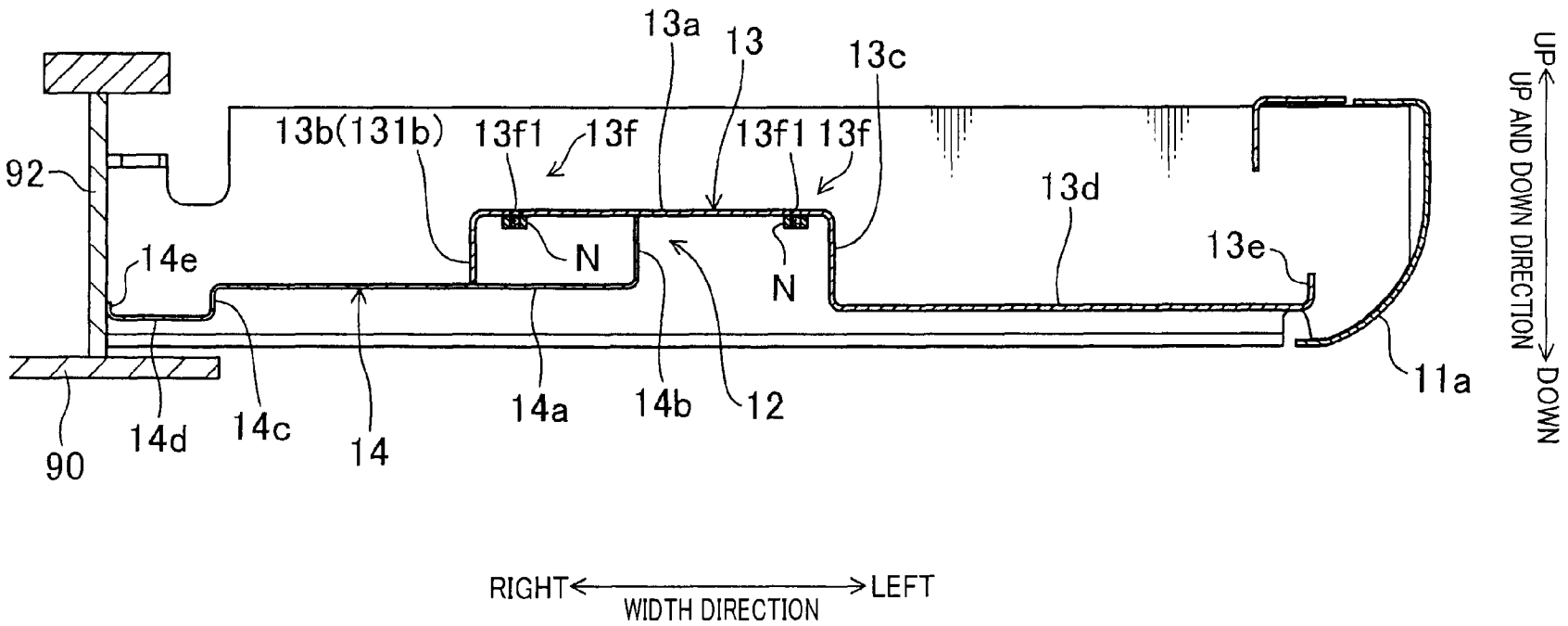
FIG. 7 is a sectional view taken along the line VII-VII in FIG. 5.
Figure 8:
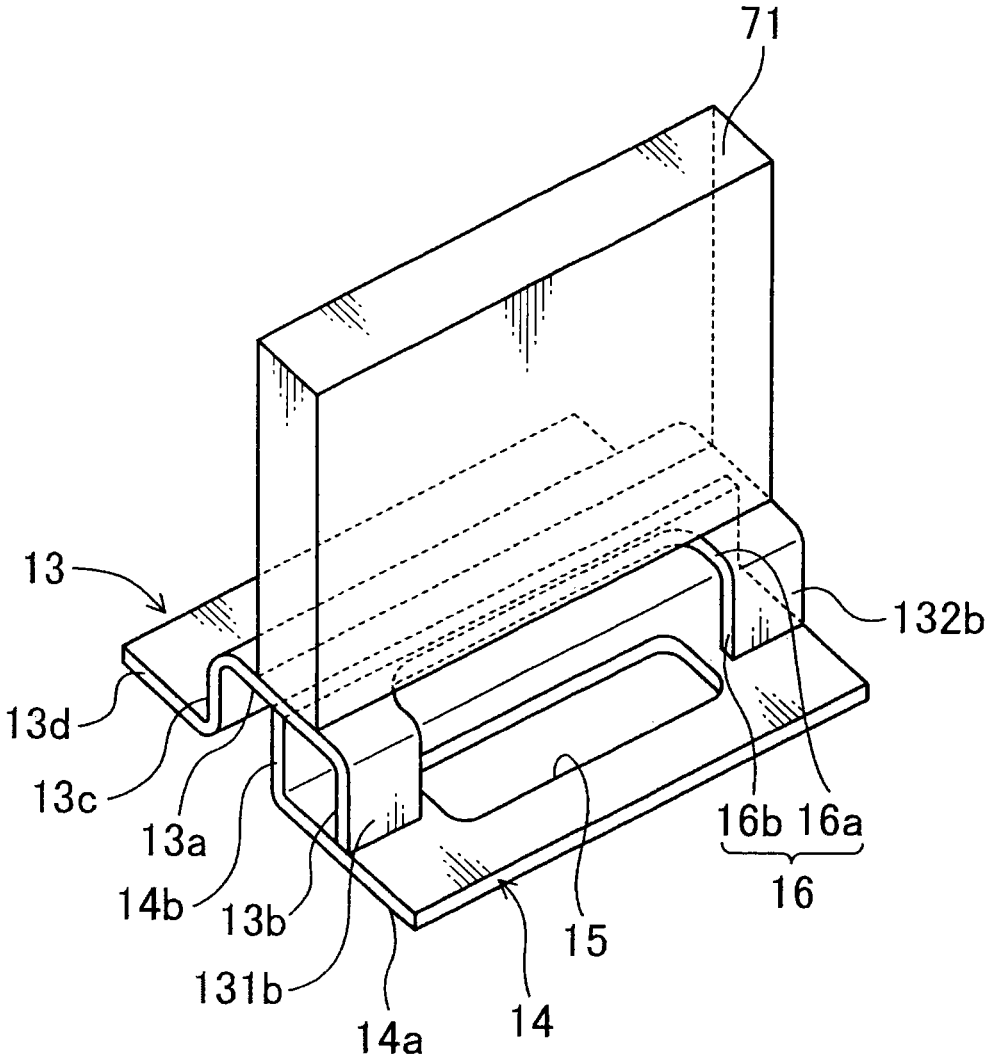
FIG. 8 is a perspective view illustrating the cooling-unit mount according to the first embodiment, wherein a cooling unit is attached thereonto.

With reference to FIGS. 5 to 8, a detailed structure of the cooling-unit mount 12 will be described below. FIG. 5 is a top plan view enlargedly illustrating the cooling-unit mount illustrated in FIG. 4. FIG. 6 is a sectional view taken along the line VI-VI in FIG. 5. FIG. 7 is a sectional view taken along the line VII-VII in FIG. 5. FIG. 8 is a perspective view illustrating the cooling-unit mount 12 according to the first embodiment, wherein the cooling unit 71 is mounted thereon.

The cooling-unit mount 12 is designed to support the cooling unit 71. Specifically, the cooling-unit mount 12 comprises an upper support member 13 for placing the cooling unit 71 thereon, and a lower support member 14 formed with a maintenance hole (lower opening) 15 for allowing maintenance of the cooling unit 71. The upper support member 13 is disposed in left region of the cooling-unit mount 12 and the lower support member 14 is disposed in right regions of the cooling-unit mount 12, in such a manner that a right end of the upper support member 13 and a left end of the lower support member 14 overlap each other in top plan view.

The upper support member 13 comprises: an upper horizontal plate portion 13*a* disposed substantially horizontally and having an upper surface for placing the cooling unit 71 thereon; an upper right vertical plate portion (first vertical plate portion) 13*b* extending vertically downwardly from a right edge of the upper horizontal plate portion 13*a*; an upper left vertical plate portion (third vertical plate portion) 13*c* extending vertically downwardly from a left edge of the upper horizontal plate portion 13*a*; and an upper baseplate portion 13*d* extending leftwardly from a lower edge of the upper left vertical plate portion 13*c*.

The upper support member 13 is prepared by subjecting a steel plate to bending. Specifically, the upper horizontal plate portion 13*a* is formed in a rectangular shape. The upper right vertical plate portion 13*b* is formed in a rectangular shape, and bent vertically downwardly from the right edge of the upper horizontal plate portion 13*a*. The upper left vertical plate portion 13*c* is formed in a rectangular shape, and bent vertically downwardly from the left edge of the upper horizontal plate portion 13*a* to extend up to a height position lower than that of a lower edge face of the upper right vertical plate portion 13*b*. The upper baseplate portion 13*d* is bent leftwardly from a lower edge of the upper left vertical plate portion 13*c* to extend substantially horizontally. As illustrated in FIG. 6, a left edge of the upper baseplate portion 13*d* is attached to the left side frame 11*a*. Further, as illustrated in FIG. 7, the upper baseplate portion 13*d* is formed with a bent portion 13*e* which is bent upwardly from a rear region of the left edge thereof.

The upper support member 13 has an upper opening formed to penetrate therethrough in an up-and-down direction so as to allow maintenance of the cooling unit 71 through the maintenance hole 15. A layout of the maintenance hole 15 will be described below. An aftermentioned lower horizontal plate portion 14*a* has a covered zone covered by a part of the upper horizontal plate portion 13*a* including the right edge thereof (upper right vertical plate portion 13*b*), and an outside zone located outside the covered zone beyond the right edge of the upper horizontal plate portion 13*a*, when viewed in top plan view. The maintenance hole 15 is formed across the covered zone and the outside zone when viewed in top plan view. The upper opening is formed in the upper support member 13 in a range including a formation range of the maintenance hole 15 when viewed in top plan view. Specifically, the upper opening is defined by a cutout 16 formed across the upper horizontal plate portion 13*a* and the upper right vertical plate portion 13*b*. The cutout 16 is formed in a longitudinally substantially central region of the upper support member 13 in a range from a right end of the upper horizontal plate portion 13*a* to a lower edge of the upper right vertical plate portion 13*b*. Specifically, the cutout 16 is formed in both a range from a right end to a right edge of the upper horizontal plate portion 13*a*, and a range from an upper edge to a lower edge of the upper right vertical plate portion 13*b*. In other words, the cutout 16 has a horizontal opening 16*a* formed in the right end of the upper horizontal plate portion 13*a* in a region approximately overlapping the maintenance hole 15 in top plan view, and a vertical opening 16*b* formed in the upper right vertical plate portion 13*b* in continuous relation with the horizontal opening 16*a*. Thus, as illustrated in FIG. 8, the upper right vertical plate portion 13*b* is separated into a front leg (first vertical plate piece) 132*b* and a rear leg (first vertical plate piece) 131*b* by the vertical opening 16*b*. Each of the legs 131*b*, 132*b* extends vertically downwardly. Respective lower ends of the legs 131*b*, 132*b*, i.e., the lower end of the upper right vertical plate portion 13*b*, are attached (joined) to an upper surface of the aftermentioned lower horizontal plate portion 14*a*.

The upper support member 13 having the above configuration can be prepared in the following manner. Firstly, one rectangular steel plate is prepared, and the cutout 16 is preliminarily formed in one of four sides of the steel plate. Then, the steel plate is bent into a convex shape, for example, by pressing.

The upper horizontal plate portion 13*a* has four fixing portions 13*f* for fixing the cooling unit 71. The fixing portions 13*f* are provided, respectively, at four corners (right front, right rear, left front and left rear corners) in top plan view. In other words, the fixing portions 13*f* are provided in the upper horizontal plate portion 13*a* at positions longitudinally outward with respect to the cutout 16. Specifically, right two of the fixing portions 13*f* are respectively provided at two segments of the right edge of the upper horizontal plate portion 13*a*, and each one of legs 131*b*, 132*b* of the upper right vertical plate portion 13*b* is provided at each one of the two segments of the upper horizontal plate portion 13*a*. Left two of the fixing portions 13*f* are provided at the left edge of the upper horizontal plate portion 13*a* at which the upper left vertical plate portion 13*c* is provided. In accordance with the above arrangement, the weight of the cooling unit 71 can be received by the upper right vertical plate portion 13*b* and the upper left vertical plate portion 13*c*, so that it becomes possible to provide high rigidity to a portion for supporting the cooling unit 71. As illustrated in FIG. 7, each of the fixing portion 13*f* comprises a mounting hole 13*f*1 formed to penetrate the upper horizontal plate portion 13*a* in the up-and-down direction, and a nut N fixedly attached to a lower surface of the upper horizontal plate portion 13*a*. A bracket (illustration is omitted) attached to a lower end of the cooling unit 71 is provided with a through-hole alignable with the mounting hole of the fixing portion 13*f*. A bolt is inserted into the through-hole aligned with the mounting hole from above the through-hole, and screwed with the nut N to fix the cooling unit 71 to the cooling-unit mount 12.

The lower support member 14 comprises: a lower horizontal plate portion 14*a* disposed substantially horizontally below the upper horizontal plate portion 13*a* and having the maintenance hole 15 formed to penetrate therethrough in the up-and-down direction; a lower left vertical plate portion (second vertical plate portion) 14*b* extending vertically upwardly from a left edge of the lower horizontal plate portion 14*a*; a lower right vertical plate portion 14*c* extending vertically downwardly from a right edge of the lower horizontal plate portion 14*a*; a lower baseplate portion 14*d* extending rightwardly from a lower edge of the lower right vertical plate portion 14*c*; and a bent portion 14*e* bent upwardly from a right edge of the lower baseplate portion 14*d*.

The lower support member 14 is prepared by subjecting a steel plate to bending. Specifically, the lower left vertical plate portion 14*b* is bent vertically upwardly from the left edge of the lower horizontal plate portion 14*a*. The lower right vertical plate portion 14*c* is bent vertically downwardly from the right edge of the lower horizontal plate portion 14*a*. The lower baseplate portion 14*d* is bent rightwardly from a lower edge of the lower right vertical plate portion 14*c*. The bent portion 14*e* is bent upwardly from a right edge of the lower baseplate portion 14*d*.

The lower horizontal plate portion 14*a* is formed in a rectangular shape in top plan view, and disposed such that a length direction thereof is oriented in the longitudinal direction. In the width direction, the lower horizontal plate portion 14*a* is provided in a range from a position just above a left edge of a rear end of the bottom plate portion 90 to a position just below a widthwise central region of the upper horizontal plate portion 13*a*. The lower horizontal plate portion 14*a* has a covered zone covered by a part of the upper horizontal plate portion 13*a* including the right edge thereof (upper right vertical plate portion 13*b*), and an outside zone located outside the covered zone beyond the right edge (upper right vertical plate portion 13*b*), when viewed in top plan view. The maintenance hole 15 is formed across the covered zone and the outside zone when viewed in top plan view.

Specifically, the maintenance hole 15 penetrates through the lower horizontal plate portion 14*a* in the up-and-down direction in a substantially central region of the lower horizontal plate portion 14*a*, in top plan view. The maintenance hole 15 is an elongate hole (see FIG. 5) longitudinally extending in a widthwise central region of the lower horizontal plate portion 14*a* (lower support member 14). The maintenance hole 15 is formed in a range covering all of the three hose-attaching portions 72 in top plan view. Specifically, in a situation where the cooling unit 71 is placed on (fixed to) the upper horizontal plate portion 13*a*, the maintenance hole 15 is provided at a position located just below the hose-attaching portions 72 (see FIG. 3). A left half of the maintenance hole 15 overlaps the horizontal opening 16*a* of the cutout 16 in top plan view. On the other hand, a right half of the maintenance hole 15 is located rightwardly with respect to the vertical opening 16*b*, i.e., the upper right vertical plate portion 13*b*. The maintenance hole 15 has a longitudinal length approximately equal to that of the cutout 16. The legs 131*b*, 132*b* (two first vertical plate pieces) formed at longitudinally opposite ends of the horizontal opening 16*a* of the cutout 16 are attached (joined) to the lower horizontal plate portion 14*a* in regions located longitudinally outward of the maintenance hole 15.

The lower left vertical plate portion 14*b* extends upwardly from a left edge of the lower horizontal plate portion 14*a* and has an upper end joined to a lower surface of the upper horizontal plate portion 13*a*. Specifically, as illustrated in FIG. 5, the lower left vertical plate portion 14*b* extends longitudinally in a widthwise substantially central position of the upper horizontal plate portion 13*a*. In other words, the upper left vertical plate portion 13*c* is disposed in a position opposite to the upper right vertical plate portion 13*b* with respect to the lower left vertical plate portion 14*b*. Thus, among the four fixing portions 13*f*, each of the two right fixing portions 13*f* is disposed at a position symmetric to each one of the two left fixing portions 13*f*, with respect to the lower left vertical plate portion 14*b*.

For example, means to attach the cooling-unit mount 12 to the upper frame 5 may include, but is not particularly limited to, the following two methods. The first method comprises: integrating the upper support member 13 and the lower support member 14; and then weld them to the upper frame 5. In the welding to the upper frame 5, a front end 12*a* and a rear end 12*b* (see FIG. 5) of an integral combination of the upper and lower support members 13, 14 are welded, respectively, to the coupling member 11*c* and the rear-end coupling member 11*d*. Further, a left end and a right end of the integral combination of the upper and lower support members 13, 14 (a left end of the upper support member 13 and a right end of the lower support member 14) are welded, respectively, to the left side frame 11*a* and the support portion 92 of the center section 9. In case of employing the first method, in order to suppress an influence of distortion due to welding (hereinafter referred to as "welding distortion") on the upper support member 13, it is preferable to partially perform welding between the upper support member 13 and the lower support member 14, instead of continuously performing the welding. Specifically, it is preferable to perform joining between the lower end of the upper right vertical plate portion 13*b* and the upper surface of the lower horizontal plate portion 14*a*, and joining between the upper end of the lower left vertical plate portion 14*b* and the lower surface of the upper horizontal plate portion 13*a*, by partial welding.

The second method comprises: welding the lower support member 14 to the upper frame 5; and then welding the upper support member 13 to the upper frame 5. Specifically, in the second method, the lower support member 14 is preliminarily welded to the coupling member 11*c*, the rear-end coupling member 11*d*, and the support portion 92 of the center section 9. Then, the upper support member 13 is welded to the coupling member 11*c*, the rear-end coupling member 11*d*, the left side frame 11*a*, and the lower support member 14. In the second method, after the lower support member 14 is preliminarily welded to the upper frame 5, the upper support member 13 is welded thereto, so that it becomes possible to minimally suppress an influence of welding distortion due to welding between the lower support member 14 and the center section 9 on the upper support member 13.

In either method, the upper horizontal plate portion 13*a*, the upper right vertical plate portion 13*b*, the lower horizontal plate portion 14*a* and the lower left vertical plate portion 14*b* defines a closed cross-section when viewed in side view. As above, the upper left vertical plate portion 13*c* is provided to the edge of the upper horizontal plate portion 13*a*, so that it becomes possible to drastically enhance rigidity of the upper horizontal plate portion 13*a* for supporting the cooling unit 71, and reduce the influence of welding distortion on the upper horizontal plate portion 13*a*, as compared to the case where the cooling-unit 71 is supported by a single flat base-plate.

In the first embodiment, during maintenance, an operator can access the three hose-attaching portions 72 from the single maintenance hole 15. Specifically, an operator can insert a tool or the like from below the maintenance hole 15 to perform maintenance in the hose-attaching portions 72.

The upper support member 13 has an upwardly convex shape formed by the upper horizontal plate portion 13*a* and the upper right and left vertical plate portions 13*b*, 13*c* provided to respective ones of the opposite edges of the upper horizontal plate portion 13*a*. In addition, the widthwise intermediate (central) region of the upper horizontal plate portion 13*a* is supported by the lower left vertical plate portion 14*b* of the lower support member 14. Thus, it becomes possible to significantly enhance rigidity and flatness of the upper horizontal plate portion 13*a*.

Further, the legs 131*b*, 132*b* formed, respectively, on the rear and front sides of the vertical opening 16*b* of the cutout 16, are welded to the lower horizontal plate portion 14*a* in the regions longitudinally outward of the maintenance hole 15. Thus, rigidity of the lower support member 14 is also enhanced.

In the first embodiment, a portion for placing the cooling unit 71 thereon is formed as a closed cross-section structure when viewed in side view, so that rigidity of the portion is enhanced to allow for addition and enlargement of the maintenance opening. Specifically, in the first embodiment, a closed cross-section is surroundedly defined by the upper horizontal plate portion 13*a* for placing the cooling unit 71 thereon, the lower horizontal plate portion 14*a*, the upper right vertical plate portion 13*b*, and the lower left vertical plate portion 14*b*. Thus, the rigidity of the portion for placing the cooling unit 71 thereon can be maintained. This makes it possible to increase the area of the maintenance hole 15 and/or the cutout 16 as compared to the conventional structure.

Typically, in a conventional cooling-unit mount, a device-supporting surface is provided on a single flat bottom plate, and this bottom plate is welded to a center section and surrounding members. Thus, welding distortion caused by the welding can directly exert an influence on flatness of the device-supporting surface. In contrast, in the first embodiment, a closed cross-section is surroundedly defined by the upper horizontal plate portion 13*a*, the upper right vertical plate portion 13*b*, the lower horizontal plate portion 14*a* and the lower left vertical plate portion 14*b*, and a surface for placing the cooling unit 71 thereon is provided on the upper horizontal plate portion 13*a*. Thus, an influence of surrounding welding distortion on the upper support member 13 can be reduced. This makes it possible to suppress the influence of welding distortion on the surface for placing the cooling unit 71 thereon, as compared to the conventional structure.

In the first embodiment, the upper right vertical plate portion 13*b* and the lower left vertical plate portion 14*b* extends, respectively, from the edges of the upper horizontal plate portion 13*a* and the lower horizontal plate portion 14*a*. Thus, each of the upper support member 13 and the lower support member 14 can be composed of a single member, which makes it possible to suppress the number of components.

In the first embodiment, the lower end of the upper right vertical plate portion 13*b* of the upper support member 13 is joined to the upper surface of the lower horizontal plate portion 14*a*, and the upper end of the lower left vertical plate portion 14*b* of the lower support member 14 is joined to the lower surface of the upper horizontal plate portion 13*a*. This makes it possible to enhance rigidity of the cooling-unit mount 12, thereby allowing for addition and enlargement of the maintenance opening 15 and cutout 16.

In the first embodiment, the upper support member 13 has the upper right vertical plate portion 13*b* and the upper left vertical plate portion 13*c* extending downwardly from respective ones of the opposite edges of the upper horizontal plate portion 13*a*. Consequently, the upper support member 13 has an upwardly convex portion (angular C shaped portion), so that the rigidity of the upper horizontal plate portion 13*a* is further enhanced. This makes it possible to further enhance the rigidity of a portion for supporting (fixing) the cooling unit 71 thereto. Accordingly, it becomes possible to further add and enlarge the maintenance opening 15 and cutout 16, while maintaining the rigidity of the portion for placing the cooling unit 71 thereon.

In the first embodiment, two angled regions are formed by the opposite edges of the upper horizontal plate portion 13*a*, and the upper right and left vertical plate portions 13*b*, 13*c* each angled with respect to a respective one of the opposite edges, and the fixing portion 13*f* is provided at each of the angled regions. Thus, the weight of the cooling unit 71 can be reliably received by the upper right vertical plate portion 13*b* and the upper left vertical plate portion 13*c*. This makes it possible to further add and enlarge the maintenance opening 15 and cutout 16, while maintaining the rigidity of the portion for placing the cooling unit 71 thereon.

In the first embodiment, the cutout 16 is provided in the upper support member 13 (the upper horizontal plate portion 13*a* and the upper right vertical plate portion 13*b*), in a range including the formation range of the maintenance hole 15, when viewed in top plan view. Thus, an operator who intends to access the cooling unit 71 through the maintenance hole 15 from therebelow can perform maintenance of the cooling unit 71 without being disturbed by the upper horizontal plate portion 13*a* and the upper right vertical plate portion 13*b*. Particularly, in the first embodiment, the maintenance hole 15 is formed across the covered zone covered by the upper horizontal plate portion 13*a* and the outside zone located outside the upper horizontal plate portion 13*a*, when viewed in top plan view. This makes it possible to allow an operator to easily access a range from a side surface to a bottom surface of the cooling unit 71.

In the first embodiment, as mentioned above, the cutout 16 is formed in a region of the upper support member 13 including a formation region of the maintenance hole 15 when viewed in top plan view, and two of the fixing portions 13*f* are provided on both sides of the cutout 16. Thus, the cooling units 71 can be placed on the upper surface of the upper support member 13 in a posture where the bottom surface of the cooling unit 71 is exposed toward the maintenance hole 15 through the cutout 16. This makes it possible to more easily access the bottom surface of the cooling unit 71 from the maintenance hole 15. Further, in the first embodiment, the two fixing portions 13*f* are respectively provided at two segments of the edge of the upper horizontal plate portion 13*a*, and each one of the legs 131*b*, 132*b* is provided at each one of the two segments of the edge of the upper horizontal plate portion 13*a*. This makes it possible to reliably support the weight of the cooling unit 71 by the two legs 131*b*, 132*b*, while exposing the bottom surface of the cooling unit 71 toward the maintenance hole 15 in the above manner.

In the first embodiment, each of the two fixing portions 13*f* provided at the right edge of the upper horizontal plate portion 13*a* is disposed symmetrically to each one of the two fixing portions 13*f* provided at the left edge of the upper horizontal plate portion 13*a*, with respect to the lower left vertical plate portion 14*b*. Thus, the weight of the cooling unit 71 can be evenly supported by the two edges of the upper horizontal plate portion 13*a* located on both sides with respect to the lower left vertical plate portion 14*b*. This makes it possible to more efficiently maintain the rigidity of the portion for placing the cooling unit 71 thereon.

(Second Embodiment)

Figure 9:
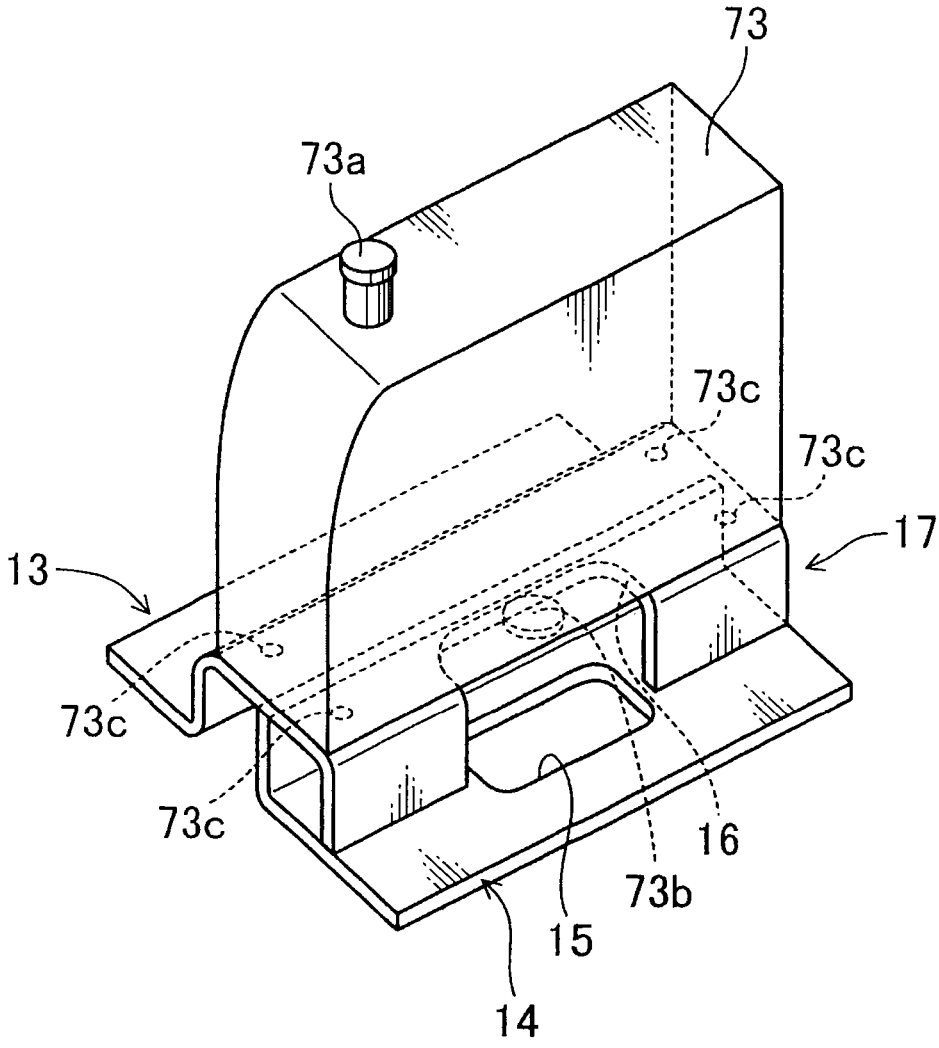
FIG. 9 is a perspective view illustrating a fuel-tank mount according to a second embodiment of the present invention, wherein a fuel tank is attached thereonto.

A second embodiment of the present invention will be described based on FIG. 9. In a device-supporting member according to the second embodiment, the present invention is applied to a fuel-tank mount for supporting a fuel tank. FIG. 9 is a perspective view illustrating a fuel-tank mount 17 according to the second embodiment, wherein a fuel tank 73 is mounted thereon. With reference to FIG. 9, a difference between the first embodiment and the second embodiment will be described below.

The fuel tank 73 is a generally rectangular parallelepiped-shaped hollow vessel for storing therein fuel such as gasoline. This fuel tank 73 has a filler portion 73*a* provided on an upper surface thereof to allow fuel to be supplied therethrough, and a maintenance portion 73*b* provided in a central region of a lower surface thereof. The fuel tank 73 also has four attaching portions 73*c* provided, respectively, at four corner of the bottom surface. The fuel-tank mount 17 has substantially the same configuration as that of the cooling-unit mount 12 according to the first embodiment.

The fuel tank 73 is placed on the fuel-tank mount 17 and attached and fixed to the fuel-tank mount 17 via the attaching portions 73*c*. When the fuel tank 73 is attached to the fuel-tank mount 17, the maintenance portion 73*b* is located on an inward side of the cutout 16. In the second embodiment, the maintenance portion 73*b* has an area less than the formation range of the three hose-attaching portions 72 of the cooling unit 71 in the first embodiment. Thus, the size of the maintenance hole 15 is less than that in the first embodiment. In the second embodiment, the rigidity of the support surface (the upper horizontal plate portion 13*a*) for placing the fuel tank 73 thereon is maintained at a high level, and the size of the maintenance hole 15 is sufficiently ensured. Thus, an operator can insert a tool or the like from the maintenance hole 15 to easily perform maintenance in the maintenance portions 73*b*.

(Other Embodiments)

It is to be understood that the present invention is not limited to the above embodiments, but various changes and modifications may be made therein without departing from the spirit and scope thereof as set forth in appended claims.

Although the first embodiment has been described based on an example in which the cooling unit is a type comprising an integral combination of a radiator, an intercooler and an oil cooler, the present invention is not limited thereto. For example, the cooling unit may be a type composed of one or two of a radiator, an intercooler and an oil cooler. Although the first and second embodiments have been described based on an example in which a device to be supported by the mount 12 or 17 is the cooling unit 71 or the fuel tank 73, the present invention is not limited thereto. The device to be supported by the mount 12 or 17 may be any type having a need to perform maintenance from therebelow, such as a hydraulic oil tank.

Although the above embodiments have been described based on an example in which the upper horizontal plate portion 13*a* and the upper right vertical plate portion 13*b* are composed of a single plate member, the present invention is not limited thereto. The upper horizontal plate portion 13*a* and the upper right vertical plate portion 13*b* may be composed of two separate plate members. Similarly, the lower horizontal plate portion 14*a* and the lower left vertical plate portion 14*b* may be composed of two separate plate members. Further, for example, the upper horizontal plate portion 13*a*, the upper right vertical plate portion 13*b*, and a right region of the lower horizontal plate portion 14*a* with respect to the upper right vertical plate portion 13*b*, may be integrally formed using a single plate, and the lower left vertical plate portion 14*b* and a left region of the lower horizontal plate portion 14*a* with respect to the upper right vertical plate portion 13*b* may be composed of a single plate member. Alternatively, the upper horizontal plate portion 13*a*, the upper right vertical plate portion 13*b*, a left region of the lower horizontal plate portion 14*a* with respect to the upper right vertical plate portion 13*b*, and the lower left vertical plate portion 14*b*, may be integrally formed using a single plate, and a right region of the lower horizontal plate portion 14*a* with respect to the upper right vertical plate portion 13*b*, the lower right vertical plate portion 14*c* and the lower bottom plate portion 14*d* may be integrally formed together. Any other suitable structure may be employed.

Although the above embodiments have been described based on an example in which the upper support member 13 is formed in an upwardly convex shape, the present invention is not limited thereto. For example, the upper support member 13 may be formed in a cross-sectionally L shape having the upper horizontal plate portion 13*a* and the upper right vertical plate portion 13*b*. Although the above embodiments have been described based on an example in which the lower support member 14 is formed in a stepped shape, the present invention is not limited thereto. For example, the lower support member 14 may be formed in a cross-sectionally L shape having the lower horizontal plate portion 14*a* and the lower left vertical plate portion 14*b*.

In the above embodiments, the lower support member 14 has one vertical plate portion (lower left vertical plate portion 14*b*) in an overlapping region with the upper support member 13 in top plan view. Alternatively, the number of the vertical plate portions may be two or more. In this case, a plurality of closed cross-sections are formed, so that the rigidity of the portion for placing the device thereon is further enhanced. Similarly, the upper support member 13 may comprise a plurality of vertical plate portions in an overlapping region with the lower support member 14.

Although the above embodiments have been described based on an example in which the lower left vertical plate portion 14*b* of the lower support member 14 is provided at the widthwise intermediate (central) position of the upper horizontal plate portion 13*a* of the upper support member 13, the present invention is not limited thereto. The lower left vertical plate portion 14*b* may be provided in widthwise overlapping relation with the upper left vertical plate portion 13*c* to form a superimposed vertical plate portion composed of the upper left vertical plate portion 13*c* and the lower left vertical plate portion 14*b*. This makes it possible to increase rigidity of the left edge of the upper horizontal plate portion 13*a*. Further, the upper right vertical plate portion 13*b* may be folded back on itself in the width direction to increase rigidity of the right edge of the upper horizontal plate portion 13*a*.

Although the above embodiments have been described based on an example in which the upper support member 13 is formed with the cutout 16, the present invention is not limited thereto. The upper support member 13 may have a hole provided to penetrate through only the upper horizontal plate portion 13*a* in the up and down direction.

Although the above embodiments have been described based on an example in which the upper end surface of the lower left vertical plate portion 14*b* is joined to the lower surface of the upper horizontal plate portion 13*a*, the present invention is not limited thereto. For example, the lower left vertical plate portion 14*b* may be formed to have an upper end bent in one of the right or left directions to extend horizontally, and the horizontally-extending region may be joined to the lower surface of the upper horizontal plate portion 13*a* in contact manner. In this case, it is preferable that the horizontal region of the upper end of the lower left vertical plate portion 14*b* is fixed to the upper horizontal plate portion 13*a*. For example, means for the fixing may include welding, and fastening using a bolt. The above configuration may also be applied to the joining between the upper right vertical plate portion 13*b* and the lower horizontal plate portion 14*a*.

Although the above embodiments have been described based on an example in which the cooling unit 71 or the fuel tank 73 is fixed to the four corners of the upper horizontal plate portion 13*a*, the present invention is not limited thereto. For example, the cooling unit 71 or the fuel tank 73 may be fixed to a region of the upper horizontal plate portion 13*a*, except widthwise opposite ends in each of longitudinally opposite ends thereof, or to a region of the upper horizontal plate portion 13*a* on the left side of the cutoff 16. However, the four corners of the upper horizontal plate portion 13*a* are located on the angled regions formed between the upper horizontal plate portion 13*a* and the upper right vertical plate portion 13*b* and between the upper horizontal plate portion 13*a* and the upper left vertical plate portion 13*c*, and superior to other positions in terms of strength. Therefore, it is advantageous to fix the cooling unit 71 or the fuel tank 73 to the four corners of the upper horizontal plate portion 13*a*, as compared to fixing the cooling unit 71 or the fuel tank 73 to a region of the upper horizontal plate portion 13*a* other than the four corners. Because the cooling unit 71 or the fuel tank 73 can be supported by a high-rigidity region of the upper horizontal plate portion 13*a*, and thus the area of the maintenance hole 15 can be increased.

Although the above embodiments has been described based on an example in which only one maintenance hole 15 is formed, the present invention is not limited thereto. A plurality of maintenance holes 15 may be formed. However, the number of steps of a process for enlargement of the maintenance opening 15 is less than that of a process for addition of the maintenance opening 15. Thus, as compared to the increase in number of the maintenance holes 15, the increase in area of the maintenance hole 15 can be achieved at a lower production cost.

Although the above embodiments have been described based on an example in which the cooling-unit mount 12 or the fuel-tank mount 17 is applied to a hydraulic shovel, the present invention is not limited thereto. The cooling-unit mount 12 and the fuel-tank mount 17 may be applied to any other suitable working machine.

In the above embodiments, the lower support member 14 is fixed to the support portion 92, and the upper support member 13 is fixed to the left side frame 11*a*. Alternatively, they may be fixed to the opposite counterparts, respectively. Further, in case of supporting a widthwise long 3-dimensional structural body, such as a hydraulic oil tank or a fuel tank, the lower support member 14 and the upper support member 13 may be fixed to the upper frame 5 in the longitudinal direction.

In the above embodiments, a relatively large maintenance hole may be formed. Thus, in order to prevent intrusion of pebbles, muddy water, dust and others, an openable and closable cover member may be provided.

In the above embodiments, the longitudinal length of the horizontal opening 16*a* of the cutout (upper opening) 16 is equal to that of the vertical opening 16*b* of the cutout 16. However, it is not essential that they are equal to each other. It is preferable to minimize the longitudinal length of the cutout 16, as long as there is no adverse effect on maintenance. The horizontal opening 16*a* and the vertical opening 16*b* may have different lengths. For example, in a situation where a bottom surface of the device (the cooling unit 71 or the fuel tank 73) does not have any portion requiring maintenance, but only a lower region of a right surface of the device has a portion requiring maintenance, the horizontal opening 16*a* may have a widthwise width for allowing a right end region of the bottom surface of the device to be exposed.

The above specific embodiments primarily include inventions having the following features.

In order to achieve the aforementioned object, the present invention provides a device-supporting member to be provided in an upper slewing body of a working machine to support a specified device. The device-supporting member comprises: an upper horizontal plate portion disposed substantially horizontally, wherein the upper horizontal plate has an upper surface for placing the device thereon; a lower horizontal plate portion disposed substantially horizontally below the upper horizontal plate portion, wherein the lower horizontal plate portion has a lower opening formed to penetrate therethrough in an up-and-down direction so as to allow maintenance of the device; and a first vertical plate portion and a second vertical plate portion each provided between the upper horizontal plate portion and the lower horizontal plate portion, wherein: the upper horizontal plate portion, the first vertical plate portion, the lower horizontal plate portion and the second vertical plate portion are arranged to define a closed cross-section when viewed in side view; and the upper horizontal plate portion has an upper opening formed to penetrate therethrough in the up-and-down direction so as to allow the maintenance of the device through the lower opening.

In the present invention, a portion for placing the device thereon is formed as a closed cross-section structure when viewed in side view, so that rigidity of the portion is enhanced to allow for addition and enlargement of the maintenance opening.

Specifically, in the present invention, a closed cross-section is surroundedly defined by the upper horizontal plate portion for placing the device thereon, the lower horizontal plate portion, the first vertical plate portion and the second vertical plate portion, so that the rigidity of the portion for placing the device thereon can be maintained. This makes it possible to add and enlarge the maintenance opening.

Preferably, in the device-supporting member of the present invention, the upper horizontal plate portion and the first vertical plate portion constitute an upper support member which comprises an integral combination of the upper horizontal plate portion and the first vertical plate portion, and the lower horizontal plate portion and the second vertical plate portion constitute a lower support member which comprises an integral combination of the lower horizontal plate portion and the second vertical plate portion, and wherein the first vertical plate portion extends downwardly from a first edge of the upper horizontal plate portion and has a lower end joined to an upper surface of the lower horizontal plate portion, and the second vertical plate portion extends upwardly from an edge of the lower horizontal plate portion and has an upper end joined to a lower surface of the upper horizontal plate portion.

In this aspect, the first vertical plate portion and the second vertical plate portion extend, respectively, from the edges of the upper horizontal plate portion and the lower horizontal plate portion. Thus, each of the upper support member and the lower support member can be composed of a single member, which makes it possible to suppress the number of components.

In addition, in this aspect, the lower end of the first vertical plate portion of the upper support member is joined to the upper surface of the lower horizontal plate portion, and the upper end of the second vertical plate portion of the lower support member is joined to the lower surface of the upper horizontal plate portion. This makes it possible to enhance rigidity of the device-supporting member, thereby allowing for addition and enlargement of the maintenance opening.

Preferably, in the above device-supporting member, the upper support member further comprises a third vertical plate portion extending downwardly from a third edge of the upper horizontal plate portion on a side opposite to the first edge with respect to the second vertical plate portion.

In this aspect, the upper support member has the first vertical plate portion and the third vertical plate portion extending downwardly from respective ones of the opposite edges of the upper horizontal plate portion. Consequently, the upper support member has an upwardly convex portion (angular reverse-C shaped portion), so that the rigidity of the upper horizontal plate portion is further enhanced. This makes it possible to further enhance the rigidity of a portion for supporting (fixing) the device thereto. Accordingly, it becomes possible to further add or enlarge the maintenance opening, while maintaining the rigidity of the portion for placing the device thereon.

Preferably, in the above device-supporting member, the upper horizontal plate portion has a fixing portion provided at the first edge to fix the device thereto.

In this aspect, an angled region is formed by the first edge of the upper horizontal plate portion and the first vertical plate angled with respect to the first vertical plate, and the fixing portion is provided at the angled region. Thus, a weight of the device can be reliably received by the first vertical plate portion. This makes it possible to further add or enlarge the maintenance opening, while maintaining the rigidity of the portion for placing the device thereon.

Preferably, in the above device-supporting member, the upper horizontal plate portion has a pair of fixing portions provided at respective ones of the first edge and the third edge to fix the device thereto.

In this aspect, two angled regions are formed by the opposite edges of the upper horizontal plate portion, and the first and third vertical plate portions each angled with respect to a respective one of the opposite edges, and the fixing portion is provided at each of the angled regions. Thus, the weight of the device can be reliably received by the first vertical plate portion and the third vertical plate portion. This makes it possible to further add or enlarge the maintenance opening, while maintaining the rigidity of the portion for placing the device thereon.

Preferably, in the above device-supporting member, the lower horizontal plate portion has a covered zone covered by a part of the upper horizontal plate portion including the first edge, and an outside zone located outside the covered zone beyond the first edge, when viewed in top plan view, and wherein the lower opening is formed across the covered zone and the outside zone when viewed in top plan view, and the upper opening is formed in a region of the upper support member including a formation region of the lower opening when viewed in top plan view.

In this aspect, the upper opening is formed in the upper support member (the upper horizontal plate portion and the first vertical plate portion), in a range including the formation range of the lower opening, when viewed in top plan view. Thus, an operator who intends to access the device through the lower opening from therebelow can perform maintenance of the device without being disturbed by the upper horizontal plate portion and the first vertical plate portion. Particularly, in this aspect, the lower opening is formed across the covered zone covered by the upper horizontal plate portion and the outside zone located outside the upper horizontal plate portion, when viewed in top plan view. This makes it possible to allow an operator to easily access a range from a side surface to a bottom surface of the device.

Specifically, the above upper opening may be defined by a cutout formed across the upper horizontal plate portion and the first vertical plate portion.

Preferably, in the above device-supporting member, the lower horizontal plate portion has a covered zone covered by a part of the upper horizontal plate portion including the first edge, and an outside zone located outside the covered zone beyond the first edge, when viewed in top plan view, wherein: the lower opening is formed across the covered zone and the outside zone when viewed in top plan view; the upper opening is formed in a region of the upper support member including a formation region of the lower opening when viewed in top plan view; the first vertical plate portion has two first vertical plate pieces separated by the upper opening; and the upper horizontal plate portion has two fixing portions respectively provided at two segments of the first edge to fix the device thereto, each one of the first vertical plate pieces being provided at each one of the two segments of the first edge.

In this aspect, the upper opening is formed in a region of the upper support member including a formation region of the lower opening when viewed in top plan view, as mentioned above, and two fixing portions are provided on both sides of the upper opening. Thus, the device can be placed on the upper surface of the upper support member in a posture where the bottom surface of the device is exposed toward the lower opening through the upper opening. This makes it possible to more easily access the bottom surface of the device from the lower opening. Further, in this aspect, the two fixing portions are respectively provided at two segments of the first edge of the upper horizontal plate portion and each one of the first vertical plate pieces is provided at each one of the two segments of the first edge. This makes it possible to reliably support the weight of the device by the two first vertical plate pieces, while exposing the bottom surface of the device toward the lower opening in the above manner.

Preferably, in the above device-supporting member, the upper support member further comprises a third vertical plate portion extending downwardly from a third edge of the upper horizontal plate portion on a side opposite to the first edge with respect to the second vertical plate portion, wherein the upper horizontal plate portion additionally has two fixing portions provided along the third edge.

In this aspect, the upper support member has the third vertical plate portion in the above manner, so that it becomes possible to further enhance the rigidity of the upper horizontal plate portion. Thus, in this aspect, it becomes possible to more reliably maintain the rigidity of the portion for placing the device thereon, while facilitating access to the bottom surface of the device through the lower opening, as mentioned above.

Preferably, in the above device-supporting member, each of the two fixing portions provided at the first edge is provided at a position symmetric to each one of the two fixing portions provided at the third edge, with respect to the second vertical plate portion, when viewed in top plan view.

In this aspect, each of the two fixing portions provided at one of the opposite edges of the upper horizontal plate portion is disposed symmetrically to each one of the two fixing portion provided at the other edge of the upper horizontal plate portion, with respect to the second vertical plate portion. Thus, the weight of the device can be evenly supported by the two edges of the upper horizontal plate portion located with respect to the second vertical plate portion. This makes it possible to more efficiently maintain the rigidity of the portion for placing the device thereon.

The present invention also provides an upper slewing body which comprises the above device-supporting member, and a device placed on the upper surface of the upper horizontal plate of the device-supporting member.

As described above, the present invention is usable in a device-supporting member for supporting a device in an upper slewing body of a working machine, to increase the area of maintenance opening, while maintaining rigidity of a portion for placing the device thereon.

This application is based on Japanese Patent application No. 2011-189449 filed in Japan Patent Office on Aug. 31, 2011, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A device-supporting member to be provided in an upper slewing body of a working machine to support a specified device, comprising:

an upper support member including an upper horizontal plate portion disposed substantially horizontally and a first vertical plate portion extending downwardly from the upper horizontal plate portion, the upper horizontal plate portion having an upper surface for placing the device thereon; and a lower support member including a lower horizontal plate portion disposed substantially horizontally below the upper horizontal plate portion and a second vertical plate portion extending upwardly from the lower horizontal plate portion, the lower horizontal plate portion having a lower opening formed to penetrate therethrough in an up-and-down direction so as to allow maintenance of the device, wherein:

the first vertical plate portion has a lower end joined to an upper surface of the lower horizontal plate portion;

the second vertical plate portion has an upper end joined to a lower surface of the upper horizontal plate portion;

the upper horizontal plate portion, the first vertical plate portion, the lower horizontal plate portion and the second vertical plate portion are arranged to define a closed cross-section when viewed in side view; and the upper horizontal plate portion has an upper opening formed to penetrate therethrough in the up-and-down direction so as to allow the maintenance of the device through the lower opening.

2. The device-supporting member according to claim 1, wherein:

the first vertical plate portion extends downwardly from a first edge of the upper horizontal plate portion; and the second vertical plate portion extends upwardly from an edge of the lower horizontal plate portion.

3. The device-supporting member according to claim 2, wherein the upper support member further comprises a third vertical plate portion extending downwardly from a third edge of the upper horizontal plate portion on a side opposite to the first edge with respect to the second vertical plate portion.

4. The device-supporting member according to claim 2, wherein the upper horizontal plate portion has a fixing portion provided at the first edge to fix the device thereto.

5. The device-supporting member according to claim 3, wherein the upper horizontal plate portion has a pair of fixing portions provided at respective ones of the first edge and the third edge to fix the device thereto.

6. The device-supporting member according to claim 2, wherein the lower horizontal plate portion has a covered zone covered by a part of the upper horizontal plate portion including the first edge, and an outside zone located outside the covered zone beyond the first edge, when viewed in top plan view, and wherein:

the lower opening is formed across the covered zone and the outside zone when viewed in top plan view; and the upper opening is formed in a region of the upper support member including a formation region of the lower opening when viewed in top plan view.

7. The device-supporting member according to claim 6, wherein the upper opening is defined by a cutout formed across the upper horizontal plate portion and the first vertical plate portion.

8. The device-supporting member according to claim 2, wherein the lower horizontal plate portion has a covered zone covered by a part of the upper horizontal plate portion including the first edge, and an outside zone located outside the covered zone beyond the first edge, when viewed in top plan view, and wherein:

the lower opening is formed across the covered zone and the outside zone when viewed in top plan view;

the upper opening is formed in a region of the upper support member including a formation region of the lower opening when viewed in top plan view;

the first vertical plate portion has two first vertical plate pieces separated by the upper opening; and the upper horizontal plate portion has two fixing portions respectively provided at two segments of the first edge to fix the device thereto, each one of the first vertical plate pieces being provided at each one of the two segments of the first edge.

9. The device-supporting member according to claim 8, wherein the upper support member further comprises a third vertical plate portion extending downwardly from a third edge of the upper horizontal plate portion on a side opposite to the first edge with respect to the second vertical plate portion, and wherein the upper horizontal plate portion additionally has two fixing portions provided along the third edge.

10. The device-supporting member according to claim 9, wherein each of the two fixing portions provided at the first edge is provided at a position symmetric to each one of the two fixing portions provided at the third edge, with respect to the second vertical plate portion, when viewed in top plan view.

11. An upper slewing body comprising:

the device-supporting member according to claim 1; and a device placed on the upper surface of the upper horizontal plate portion of the device-supporting member.

* * * * *